US007878496B2

(12) United States Patent
Fujii et al.

(10) Patent No.: US 7,878,496 B2
(45) Date of Patent: Feb. 1, 2011

(54) SHEET PROCESSING APPARATUS AND IMAGE FORMING APPARATUS

(75) Inventors: Takayuki Fujii, Tokyo (JP); Manabu Yamauchi, Kashiwa (JP); Naoto Watanabe, Abiko (JP); Shunsuke Nishimura, Toride (JP); Yushi Oka, Abiko (JP); Toshiyuki Miyake, Toride (JP); Takashi Yokoya, Kashiwa (JP); Hidenori Matsumoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/061,800

(22) Filed: Apr. 3, 2008

(65) Prior Publication Data

US 2008/0246205 A1 Oct. 9, 2008

(30) Foreign Application Priority Data

Apr. 4, 2007 (JP) ..... 2007-098418

(51) Int. Cl.
*B65H 33/04* (2006.01)
*B65H 39/00* (2006.01)

(52) U.S. Cl. ..... 270/58.07; 270/58.08; 270/58.09

(58) Field of Classification Search ..... 270/58.07, 270/58.08, 58.09
See application file for complete search history.

(56) References Cited

U.S. PATENT DOCUMENTS 5,535,012 A 7/1996 Matsumoto et al. ..... 358/400
6,330,422 B1 12/2001 Sato et al. ..... 399/382
6,493,113 B1 12/2002 Fujii et al. ..... 358/488
6,636,720 B2 10/2003 Fujii et al. ..... 399/382
6,845,228 B2 1/2005 Suzuki et al. ..... 399/407
6,904,261 B2 6/2005 Fujii et al. ..... 399/382
7,050,751 B2 5/2006 Watanabe et al. ..... 399/391

FOREIGN PATENT DOCUMENTS

JP 2005-138549 6/2005
JP 2007-76840 3/2007
JP 2007076840 A * 3/2007

* cited by examiner

*Primary Examiner*—Gene Crawford
*Assistant Examiner*—Yolanda Cumbess
(74) *Attorney, Agent, or Firm*—Fitzpatrick, Cella, Harper & Scinto

(57) ABSTRACT

A sheet processing apparatus for binding a sheet bundle by a binding member having a curved shape, including: a support portion configured to support, as a sheet bundle, a plurality of sheets having punch holes formed therein; an adjustment portion configured to adjust a position of each of punch holes formed in the sheet bundle so that a locus of centers of the punch holes continuing in a thickness direction of the sheet bundle supported by the support portion is aligned with the curved shape of the binding member; and an attaching portion configured to attach the binding member to the punch holes of the sheet bundle in which the position of each of the plurality of sheets is adjusted by the adjustment portion.

7 Claims, 13 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus.

2. Description of the Related Art

Up to now, in a sheet processing apparatus connected to an image forming apparatus such as a copying machine or a printer, bookbinding processing including binding of a plurality of sheets each having an image formed thereon is performed. In the bookbinding processing, for example, a staple or glue is used. The bookbinding processing using the staple includes corner or side stitching for stitching a sheet bundle at a corner thereof with a staple, and saddle stitching for stitching sheets at a center thereof with a staple to be folded in half at a stapling position. The bookbinding processing using the glue includes case binding for applying a glue onto a back portion of a sheet bundle to adhere to a cover sheet having a size substantially twice as large as that of the sheet bundle so as to cover the sheet bundle with the cover sheet, and spine tape binding for gluing a band-like tape on the back portion of the sheet bundle.

In addition, there is another bookbinding processing such as ring binding in which punch holes are formed at an edge of each sheet having an image formed thereon, and the sheets are sequentially stacked to be formed into a sheet bundle, to thereby attach a ring-type binder to the punch holes of the formed sheet bundle (see Japanese Patent Application Laid-Open No. 2005-138549). The sheet bundle subjected to the ring binding is advantageous in its good appearance and ease of handling as a document. Accordingly, many users prefer the ring binding.

Incidentally, in a binding processor disclosed in Japanese Patent Application Laid-Open No. 2005-138549, in a case of performing the ring binding, first, each sheet received from an image forming apparatus is subjected to a process for forming punch holes at the edge of each sheet. Then, such bookbinding processing is executed that the ring-type binder is attached to the punch holes of the sheet bundle having a plurality of sheets that are subjected to the above-mentioned process and stacked therein.

However, such an attachment process depends on an accuracy of a relative position of the hole to be formed in each sheet, an alignment performance of the sheets to be stacked after being punched, and the like. If the accuracy of the relative position of the hole formed in each sheet is low or if the alignment performance of the sheets to be stacked after being punched is not excellent, the sheet bundle having sheets stacked therein and the hole of the sheet bundle are in a state as illustrated in FIG. 20, for example. In FIG. 20, both the accuracy of positions of punch holes Hd and the alignment performance of a sheet bundle Pa are not excellent. Accordingly, the positions of the punch holes Hd become uneven between an uppermost sheet Pa1 and a lowermost sheet Pa2 of the sheet bundle Pa. As a result, it is difficult to attach a binder Bd through the entire hole of the sheet bundle Pa.

Even when the accuracy of the relative position of the hole formed in each sheet is excellent and the alignment performance of the sheets to be stacked after being punched is also excellent, in the ring bookbinding, there arises another problem as illustrated in FIG. 21. As illustrated in FIG. 21, when a plurality of sheets P are stacked, the sheets P have a total thickness corresponding to a thickness of the sheet bundle Pa. For this reason, when the ring-type binder Bd is caused to pass through the hole of the sheet bundle Pa, at each position of a hole inner portion "i" of the uppermost sheet, a hole inner portion "iii" of the lowermost sheet, and a hole inner portion "ii" of the sheet positioned near a center of the sheet bundle Pa, a distance between the binder Bd and the sheet bundle Pa becomes shorter. Accordingly, when a relative positional relation between the sheet bundle Pa and the binder Bd to be attached deviates only by a small extent, the binder Bd may be brought into contact with the sheet bundle Pa, to be deformed, for example, and the binder Bd cannot be passed through the punch hole Hd, whereby the binder cannot be attached to the sheet bundle Pa in some cases. Further, when the binder Bd is brought into contact with the sheet bundle Pa in attaching the binder Bd, there is a fear that the sheets are abraded by the binder Bd to be damaged.

By the way, there is known a technology disclosed in Japanese Patent Application Laid-Open No. 2007-76840. In the technology disclosed in Japanese Patent Application Laid-Open No. 2007-76840, a punching device is moved so that a position of a hole to be punched by the punching device can be changed in a direction orthogonal to a binding side of sheets to be filed. Then, a controller sets a distance between the hole to be punched by the punching device and the edge on the side to be bound, based on information on a number-of-sheets counter and a shape of a clamp, and changes the position to be punched by the punching device. However, in the structure disclosed in Japanese Patent Application Laid-Open No. 2007-76840, an apparatus for moving the punching device becomes larger in scale and size, and costs thereof are high.

SUMMARY OF THE INVENTION

In view of the above-mentioned circumstances, the present invention has been made, and therefore an object of the present invention is to provide a sheet processing apparatus and an image forming apparatus capable of improving an attachment performance of a binding member with respect to a punch hole formed in a sheet bundle at low cost.

According to the present invention, there is provided a sheet processing apparatus for binding a sheet bundle with a binding member having a curved shape, including: a support portion configured to support, as a sheet bundle, a plurality of sheets having punch holes formed therein; an adjustment portion configured to adjust a position of each of punch holes formed in the sheet bundle so that a locus of centers of the punch holes continuing in a thickness direction of the sheet bundle supported by the support portion is aligned with the curved shape of the binding member; and an attaching portion configured to attach the binding member to the punch holes of the sheet bundle in which the position of each of the plurality of sheets is adjusted by the adjustment portion.

According to the present invention, the attachment performance of the binding member can be improved with a simple structure.

Further features of the present invention will become apparent from the following description of exemplary embodiments with reference to the attached drawings.

DESCRIPTION OF THE EMBODIMENT

Hereinafter, exemplary embodiments for carrying out the present invention will be described in detail with reference to the drawings.

Figure 1:
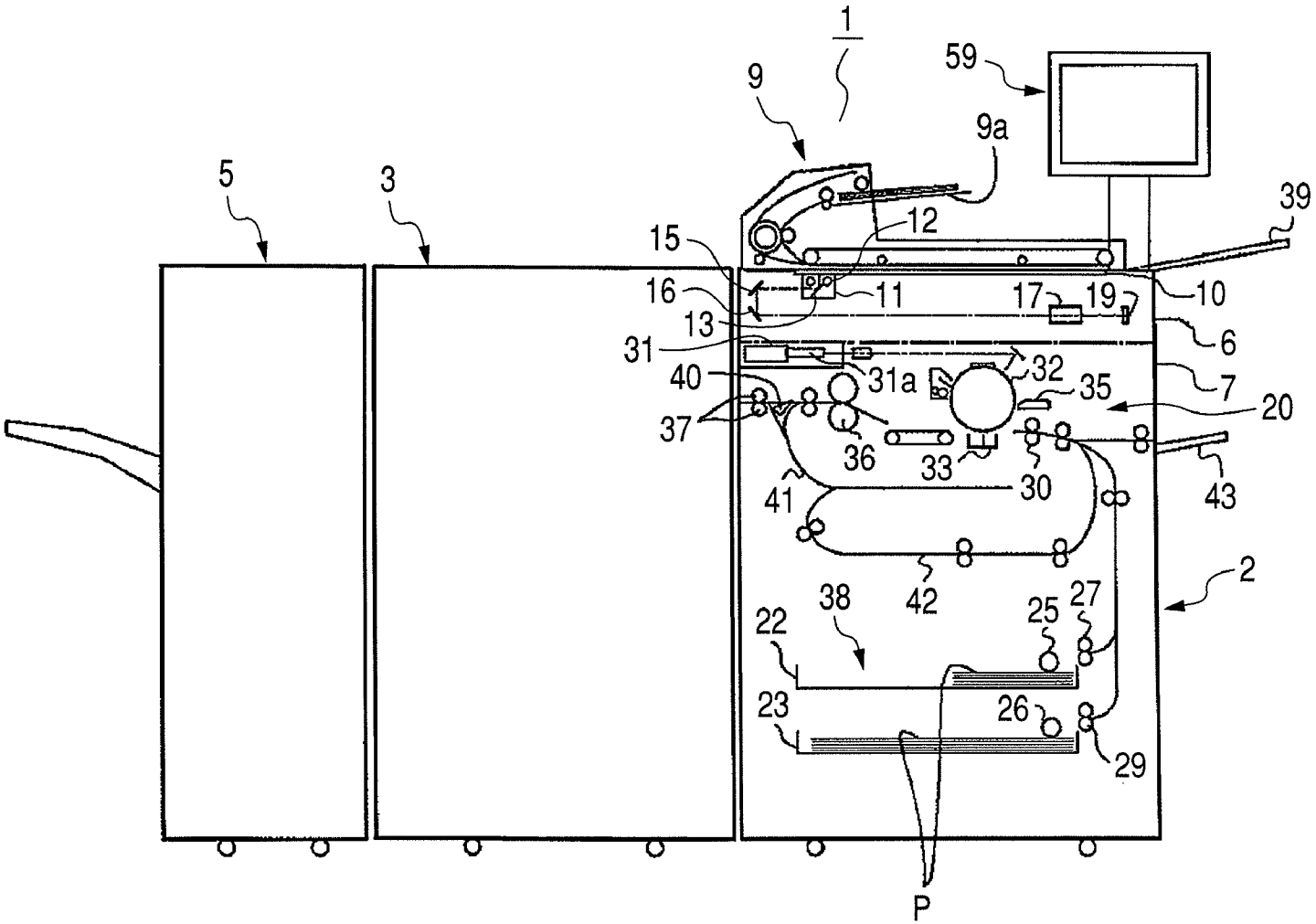
FIG. 1 is a schematic diagram illustrating an image forming apparatus provided with a sheet processing apparatus according to an embodiment of the present invention.

FIG. 1 is a schematic diagram illustrating an image forming apparatus 1 including a sheet processing apparatus 3 according to an embodiment of the present invention.

As illustrated in FIG. 1, the image forming apparatus 1 includes an image forming apparatus main body 2 and the sheet processing apparatus 3. The image forming apparatus main body 2 includes an image reader 6 for reading an image from an original, and a printer 7 for forming on a sheet the image read by the image reader 6. Note that the sheet processing apparatus 3 may be detachably attached to the image forming apparatus main body 2 as an option, or may be integrally incorporated into a frame (not illustrated) of the image forming apparatus main body 2. The sheet processing apparatus 3 according to the embodiment of the present invention includes a discharged sheet stacking portion 5 provided outside the sheet processing apparatus 3, for discharging and stacking sheets each having an image formed thereon in the image forming apparatus main body 2.

In an upper portion of the image reader 6 of the image forming apparatus main body 2, there is mounted an original feeding device 9 for feeding originals set on an original tray 9*a* one by one. The image reader 6 includes a platen glass 10, a scanner unit 11 provided below the platen glass 10, and a lamp 12 provided to the scanner unit 11, for irradiating light to a read surface of an original. The image reader 6 further includes mirrors 13, 15, and 16, and a lens 17, which reflect/transmit reflected light of the lamp 12 reflected back from the original, and an image sensor 19 for reading the reflected light.

The printer 7 includes a sheet feeding device 38 for feeding a sheet such as a recording sheet, and an image forming portion 20 for forming an image on each of sheets P fed from the sheet feeding device 38.

The sheet feeding device 38 includes an upper cassette 22 and a lower cassette 23, which are sheet feed cassettes, pickup rollers 25 and 26, and sheet feed rollers 27 and 29. The sheets P contained in the upper cassette 22 and the lower cassette 23 are separated one by one and fed by the action of the pickup rollers 25 and 26 and the sheet feed rollers 27 and 29 which ascend/descend and rotate at a predetermined timing. The sheets P fed from the sheet feeding device 38 are guided to a conveyance path, and registration rollers 30 are disposed along the conveyance path.

The image forming portion 20 employs an electrophotographic process, and includes an exposure controlling portion 31 for outputting a laser beam for forming an image, and a photosensitive drum 32 serving as an image bearing member. The exposure controlling portion 31 is provided with a polygon minor 31*a* for scanning the laser beam. The image forming portion 20 further includes a developing device 35 for supplying a developer to the photosensitive drum 32, and a transferring portion 33 for transferring the developer for the photosensitive drum 32 onto a sheet. At a downstream side of the conveyance path from the transferring portion 33, a fixing portion 36 is disposed. Further, at a downstream side of the fixing portion 36, there are disposed a flapper 40 for switching a sheet advancing direction, and discharge rollers 37 for discharging the sheet having the image formed thereon to the outside of the image forming apparatus main body 2.

Next, a description is given of operations of each portion of the image forming apparatus main body 2 having the above-mentioned structure.

The original feeding device 9 mounted to the image reader 6 feeds originals, which are set face-up on the original tray 9*a*, leftward in front view one by one from a top sheet. Each of the fed originals is conveyed from left to right on the platen glass 10 through a flow reading position via a curved path. After that, the original is discharged to a delivery tray 39 provided outside the image forming apparatus main body 2. When the original is fed from left to right through the reading position on the platen glass 10, an image formed on the original is read by the scanner unit 11 disposed at the flow reading position. Such a reading method is called flow reading. In a case where the original passes through the flow reading position, when the read surface of the original is irradiated with light of the lamp 12 of the scanner unit 11, the reflected light from the original is guided to the lens 17 through the mirrors 13, 15, and 16. The light passing through the lens 17 forms an image on an imaging surface of the image sensor 19.

Further, in the flow reading, scanning for reading the original is performed assuming that a direction orthogonal to an original conveying direction is set as a main scanning direction and a sheet conveying direction is set as a sub-scanning direction. In other words, when the original passes through the flow reading position, the original is conveyed in the sub-scanning direction while the image formed on the original is read for every line by the image sensor 19, to thereby subsequently perform reading of the entire image formed on the original. As described above, the image formed on the original, which is optically read, is converted into image data by the image sensor 19 to be output. The image data output from the image sensor 19 is input as a video signal to the exposure controlling portion 31 of the printer 7.

Note that, when the original is read without use of the original feeding device 9, the original feeding device 9 is lifted so as to be inclined using a hinge (not illustrated) provided on a back side in front view as a shaft. Then, the original is placed on the platen glass 10, and the original feeding device 9 is returned to an original state again. In this state, the scanner unit 11 is caused to scan the original from left to right, thereby enabling original reading. Such a reading method is called original fixed reading.

On the other hand, the exposure controlling portion 31 of the printer 7 modulates and outputs the laser beam in response to the video signal input from the image reader 6. The laser beam is irradiated on a surface of the photosensitive drum 32 while being scanned by the polygon mirror 31*a*. On the photosensitive drum 32 which is charged in advance, an electrostatic latent image corresponding to the scanned laser beam is formed. In this case, during the original fixed reading, the exposure controlling portion 31 outputs the laser beam so that a normal image (not a mirror image) can be formed. The electrostatic latent image formed on the photosensitive drum 32 is visualized as a developer image with a developer supplied from the developing device 35.

Further, the sheet fed from the upper cassette 22 or the lower cassette 23 by the pickup roller 25 or the pickup roller 26 in the printer 7 is conveyed to the registration rollers 30 by the sheet feed rollers 27 or the sheet feed rollers 29. When a leading edge of the conveyed sheet reaches the registration rollers 30, the registration rollers 30 are driven at an arbitrary timing so as to convey the sheet between the photosensitive drum 32 and the transferring portion 33 at a timing synchronized with a start of the irradiation of the laser beam of the exposure controlling portion 31. In this case, the developer image formed on the photosensitive drum 32 is transferred onto the conveyed sheet by the transferring portion 33. The sheet having the developer image transferred thereto is conveyed to the fixing portion 36, and the sheet is heated and pressurized by the fixing portion 36, whereby the developer image is fixed onto the sheet. Then, the sheet passing through the fixing portion 36 is discharged to the outside (sheet processing apparatus 3) of the image forming apparatus main body 2 from the printer 7 through the flapper 40 and the discharge rollers 37.

In this case, in order to discharge the sheet having the image formed thereon from the printer 7, with an image forming surface facing down (face-down), processing using a sheet surface reverse path 41 is performed. In the processing, the sheet passing through the fixing portion 36 is temporarily guided to the sheet surface reverse path 41 by a switching operation of the flapper 40, and after a trailing edge of the sheet passes through the flapper 40, the sheet is switched back to be discharged from the printer 7 by the discharge rollers 37. Such a sheet discharge mode is generally called reverse sheet discharge. The reverse sheet discharge is performed in a case of sequentially forming an image on a plurality of originals from the top sheet, for example, in a case of reading the original from the original feeding device 9 to form an image on the original, or in a case of forming an image corresponding to an output image from a computer. The sheets are arranged in a page order and are discharged.

Further, in a case of two-side recording for forming images on both surfaces of a sheet, the sheet is guided to the sheet surface reverse path 41 by the switching operation of the flapper 40. After that, control is performed such that the sheet is conveyed to a duplex conveying path 42, and the sheet having been guided to the duplex conveying path 42 is re-fed between the photosensitive drum 32 and the transferring portion 33.

Further, in a case of forming an image on a hard sheet such as an OHP sheet, the sheet is fed from a manual feed portion 43 provided on a right side in front view of the image forming apparatus main body 2. In the case of forming an image on the sheet fed from the manual feed portion 43, the sheet is not guided to the sheet surface reverse path 41, but is discharged through the discharge rollers 37 with the image forming surface facing up (face-up).

As described above, the sheet having the image formed thereon in the image forming apparatus main body 2 is discharged from the printer 7 of the image forming apparatus main body 2 to be conveyed to the sheet processing apparatus 3.

Figure 2:
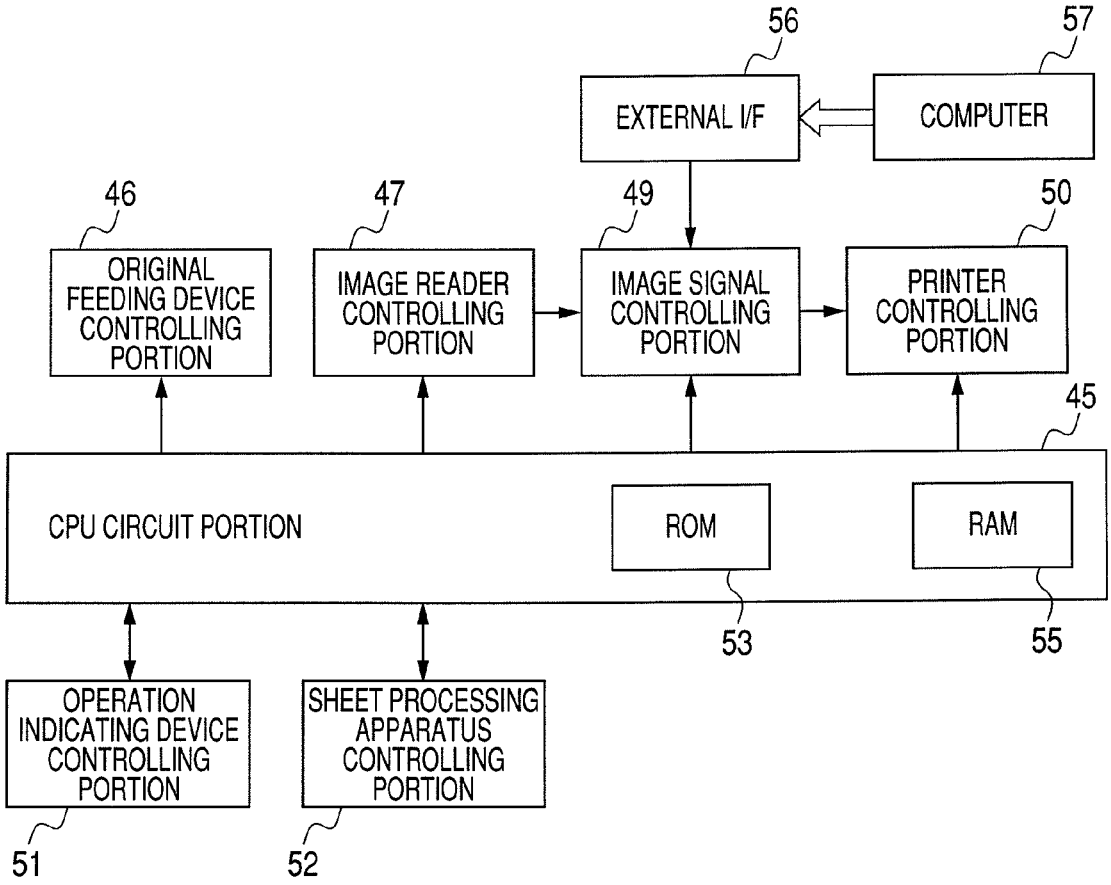
FIG. 2 is a block diagram illustrating a control system of the image forming apparatus illustrated in FIG. 1.

Next, a description is given of a control system of the image forming apparatus main body 2 according to the embodiment of the present invention with reference to FIG. 2. FIG. 2 is a block diagram illustrating the control system of the image forming apparatus main body 2.

That is, as illustrated in FIG. 2, the control system includes a CPU circuit portion 45, and an original feeding device controlling portion 46, an image reader controlling portion 47, an image signal controlling portion 49, and a printer controlling portion 50 which are electrically connected to the CPU circuit portion 45. The control system further includes an operation indicating device controlling portion 51 and a sheet processing apparatus controlling portion 52 which are electrically connected to the CPU circuit portion 45.

The CPU circuit portion 45 includes a CPU (not illustrated), a ROM 53, and a RAM 55 incorporated therein. The ROM 53 stores a control program for controlling the original feeding device controlling portion 46, the image reader controlling portion 47, the image signal controlling portion 49, an external I/F 56, the printer controlling portion 50, the operation indicating device controlling portion 51, and the sheet processing apparatus controlling portion 52, as a whole. The RAM 55 is used as a storage area for temporarily storing the control program, control data referred to by the control program, and the like, and as a work area for arithmetic processing in association with the control for the image forming apparatus 1.

The original feeding device controlling portion 46 drives and controls the original feeding device 9 in response to a command from the CPU circuit portion 45. The image reader controlling portion 47 drives and controls the scanner unit 11, the image sensor 19, and the like in response to the command from the CPU circuit portion 45, and transfers an analog image signal, which is output from the image sensor 19, to the image signal controlling portion 49.

After converting the analog image signal output from the image sensor 19 into a digital image signal, the image signal controlling portion 49 subjects the digital image signal to various image processing (correction processing and the like). Then, the image signal controlling portion 49 converts the digital image signal into a video signal to output the video signal to the printer controlling portion 50. Further, after converting an analog image signal, which is input from a computer 57 via the external I/F 56, into a digital image signal, the image signal controlling portion 49 subjects the digital image signal to various image processing, and converts the digital image signal into a video signal to output the video signal to the printer controlling portion 50. The printer controlling portion 50 drives the exposure controlling portion 31 (see FIG. 1) in response to the video signal input from the image signal controlling portion 49. Note that the processing operations of the image signal controlling portion 49 are controlled in response to the command from the CPU circuit portion 45.

The operation indicating device controlling portion 51 controls input/output of various information data between an operation indicating device 59 (see FIG. 1) and the CPU circuit portion 45. The operation indicating device 59 includes multiple keys for setting various functions relating to image formation, and a display for displaying information indicating a setting state. The operation indicating device 59 outputs a key signal corresponding to each key operation to the CPU circuit portion 45, and displays, on the display, information corresponding to a signal sent from the CPU circuit portion 45.

The sheet processing apparatus controlling portion 52 is mounted to the sheet processing apparatus 3, for example, as a control board, and inputs/outputs information data to/from the CPU circuit portion 45, to thereby drive and control the entirety of the sheet processing apparatus 3. Details of the control for the sheet processing apparatus controlling portion 52 will be described later.

Figure 3:
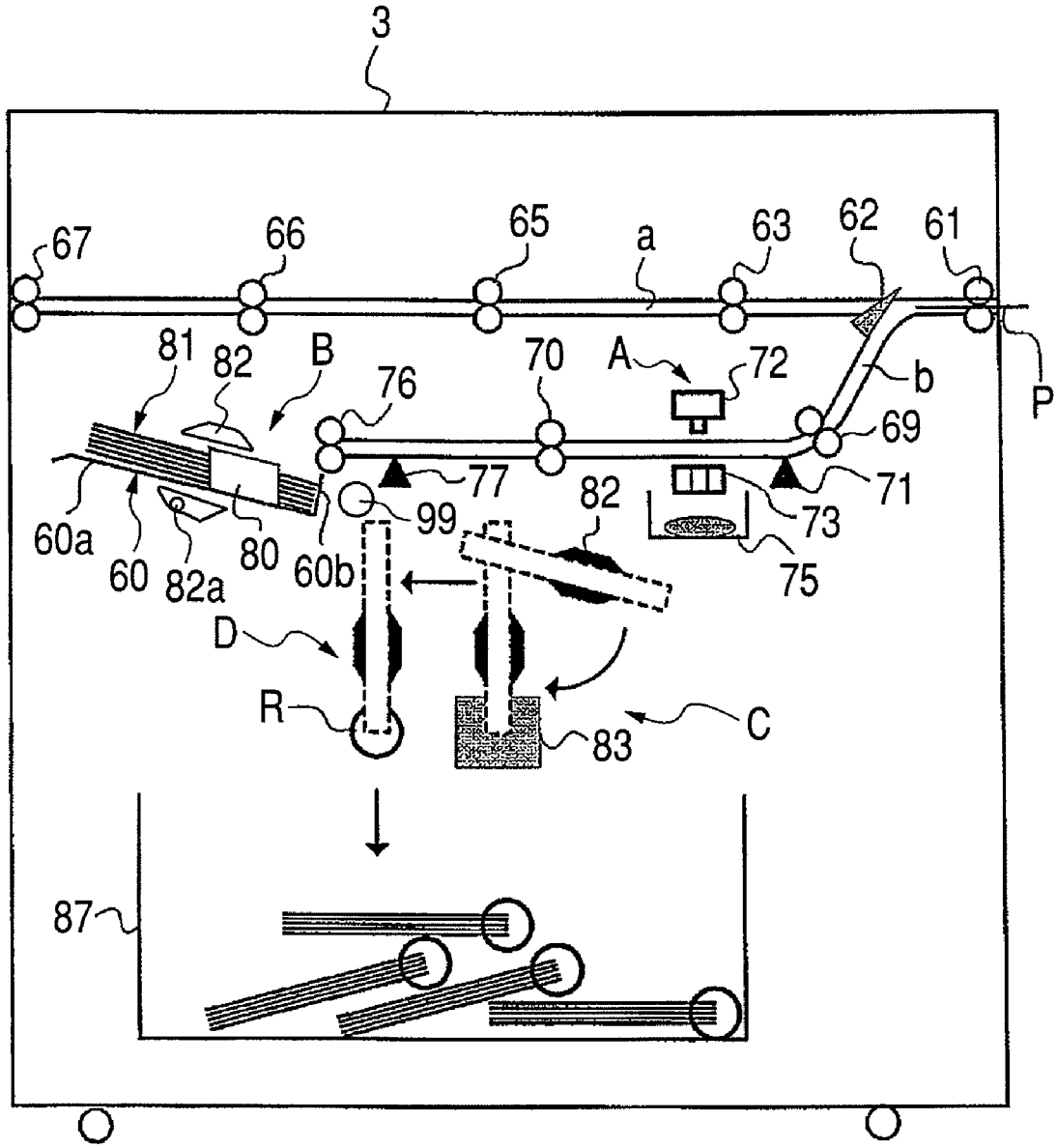
FIG. 3 is a schematic diagram illustrating an outline of an internal structure of the sheet processing apparatus.

Next, a description is given of a structure of the sheet processing apparatus 3 with reference to FIG. 3. FIG. 3 is a schematic diagram illustrating an outline of an internal structure of the sheet processing apparatus 3.

As illustrated in FIG. 3, the sheet processing apparatus 3 includes a conveyance path "a" for conveying the sheets P received from the image forming apparatus main body 2 to the discharged sheet stacking portion 5. The sheet processing apparatus 3 further includes a conveyance path "b" for subjecting the sheets P received from the image forming apparatus main body 2 to a part of the bookbinding processing, and for conveying the sheets P to a stacking portion (stacking unit) 60.

At an upstream side of a branch point between the conveyance paths "a" and "b", there is disposed a conveyance roller pair 61 for conveying the sheets P, which are discharged from the image forming apparatus main body 2, to the inside of the sheet processing apparatus 3. At the branch point between the conveyance paths "a" and "b", there is disposed a switching flapper 62 for switching the advancing direction of the sheets P conveyed by the conveyance roller pair 61 to the conveyance path "a" or the conveyance path "b". The switching flapper 62 is switched and driven by a solenoid (not illustrated). When the switching flapper 62 is not switched and driven, all the sheets P conveyed by the conveyance roller pair 61 are guided to the conveyance path "a". Meanwhile, when the switching flapper 62 is switched and driven as illustrated in FIG. 3, the sheets P conveyed by the conveyance roller pair 61 are guided to the conveyance path "b".

Along the conveyance path "a", conveyance roller pairs 63, 65, 66, and 67 are disposed in the stated order. The conveyance roller pairs 63, 65, 66, and 67 convey the sheets P, which are guided to the conveyance path "a", to the discharged sheet stacking portion 5. Along the conveyance path "b", a conveyance roller pair 69, a punch trailing edge sensor 71, a conveyance roller pair 70, a sheet discharge sensor 77, and discharge rollers 76 are disposed. Between the punch trailing edge sensor 71 and the conveyance roller pair 70 disposed along the conveyance path "b", a sheet punch portion (punch unit) A is disposed. The sheets P conveyed to the conveyance path "b" are subjected to the bookbinding processing by a sheet stacking portion B and a bookbinding portion C that are disposed in the stated order from the sheet punch portion A via the conveyance path "b".

The sheet punch portion A includes a punch unit 72 for subjecting the sheets to punching processing, a receiving portion 73 for receiving the punch unit 72, and a punch chad box 75 for containing chads discharged after the punching processing.

The sheet stacking portion B includes a stacking portion 60 disposed at a downstream side in a sheet discharging direction of the discharge rollers 76, and a width aligning member 80 for aligning sheet bundles stacked on the stacking portion 60 in a width direction. The stacking portion 60 includes a support tray 60*a* serving as a support portion for supporting the sheet bundles, and a plate-like abutment member 60*b* for supporting one edge of each of the sheet bundles stacked on the support tray 60*a*. Note that, as described later, the plate-like abutment member 60*b* is capable of retracting from the support tray 60*a*. Further, the sheet stacking portion B is provided with a cylindrical abutment member 99 which abuts against the edge of each of the sheet bundles in a state where the plate-like abutment member 60*b* retracts.

The bookbinding portion C includes a gripper 82 for gripping a sheet bundle (a plurality of sheets) 81 conveyed from the sheet stacking portion B, and a binding member carrying portion (attaching portion) 83 for attaching the binding member to the sheet bundle 81. Below the bookbinding portion C, a sheet bundle stacking box 87 is disposed.

Figure 4:
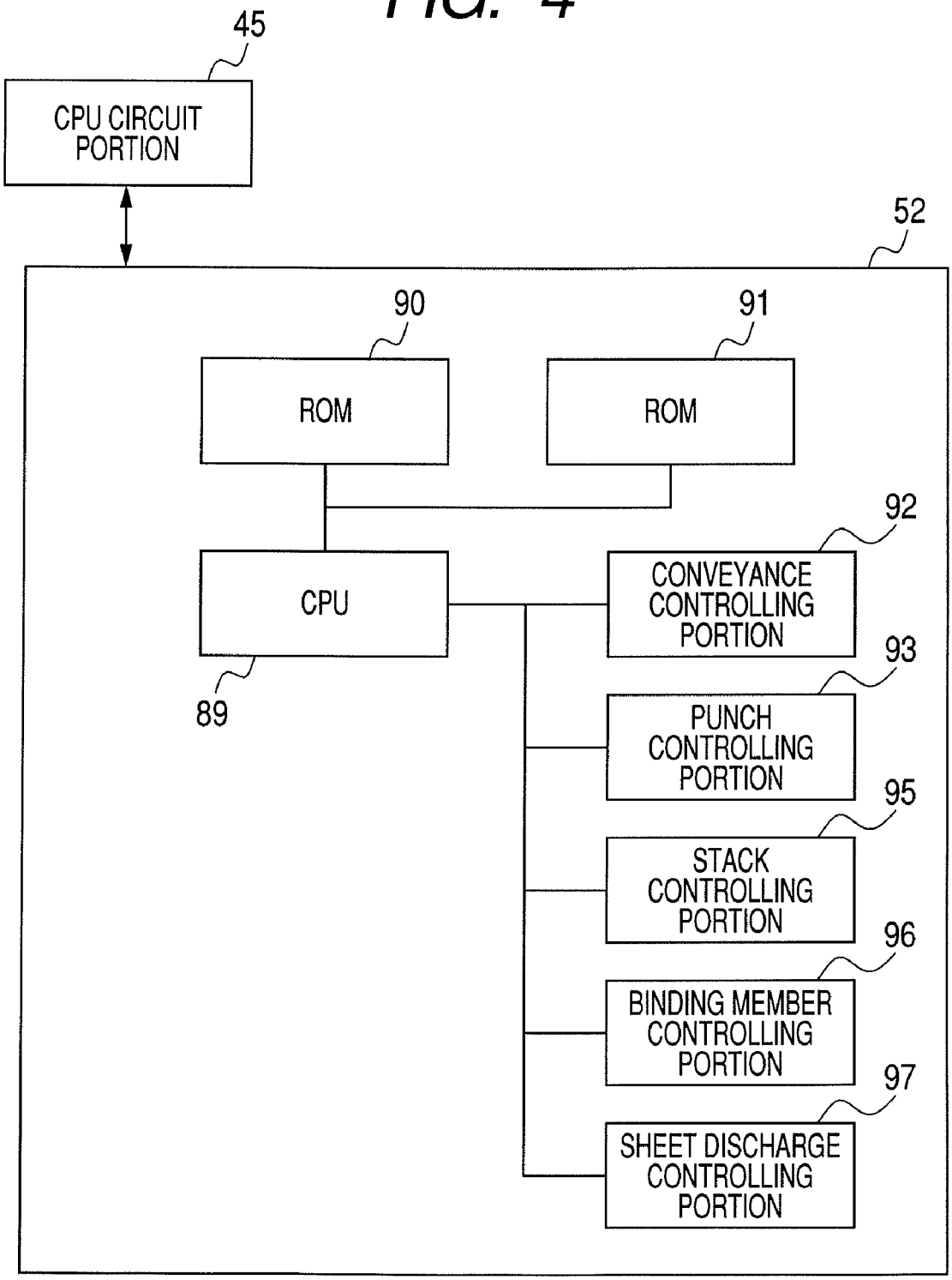
FIG. 4 is a block diagram illustrating the sheet processing apparatus.

Next, a description is given of the sheet processing apparatus controlling portion 52 for controlling the sheet processing apparatus 3 with reference to FIG. 4.

As illustrated in FIG. 4, the sheet processing apparatus controlling portion 52 includes a CPU 89, a ROM 90, and a RAM 91. The CPU 89 performs various controls as a whole by appropriate use of resources of the ROM 90 and the RAM 91. The ROM 90 stores a control program for controlling the control portions to be described later as a whole. The RAM 91 is used as a storage area for temporarily storing the control program, control data referred to by the control program, and the like, and as a work area for arithmetic processing in association with the control for the sheet processing apparatus 3.

Further, the CPU 89 executes and controls control portions including a conveyance controlling portion 92, a punch controlling portion 93, a stack controlling portion 95, a binding member controlling portion 96, and a sheet discharge controlling portion 97. The conveyance controlling portion 92 drives and controls sheet conveyance by the conveyance roller pairs 61, 69, and 70, the discharge rollers 76, and the like. The punch controlling portion 93 drives and controls the sheet punch portion A. The stack controlling portion 95 drives and controls the sheet stacking portion B. The binding member controlling portion 96 drives and controls the bookbinding portion C. The sheet discharge controlling portion 97 drives and controls a book-bound sheet bundle discharge portion D for discharging a book-bound bundle to the sheet bundle stacking box 87.

Then, the sheet processing apparatus controlling portion 52 performs data exchange and the like with the CPU circuit portion 45, which is provided to the image forming apparatus main body 2, via a communication IC (not illustrated), to thereby execute the bookbinding processing. In the sheet processing apparatus controlling portion 52, in response to the command from the CPU circuit portion 45 of the image forming apparatus main body 2, various programs stored in the ROM 90 are executed, and the sheet processing apparatus 3 is driven and controlled.

Note that it has been described that the CPU 89 is incorporated into the sheet processing apparatus controlling portion 52 of the sheet processing apparatus 3, but the CPU 89 may be incorporated into the control board included in the image forming apparatus main body 2 or the like. Further, a CPU provided in an information device such as a separate personal computer may be used, and the CPU for performing control processing for the sheet processing apparatus 3 is not necessarily included in the sheet processing apparatus 3 itself. Thus, in a case where the CPU is included in a separate information device, signals are transmitted/received through a communication line or the like (whether wired or wireless), whereby various control processings are executed. The above-mentioned modes can be applied not only to the CPU but also to the RAM, the ROM, and the like.

Figure 5:
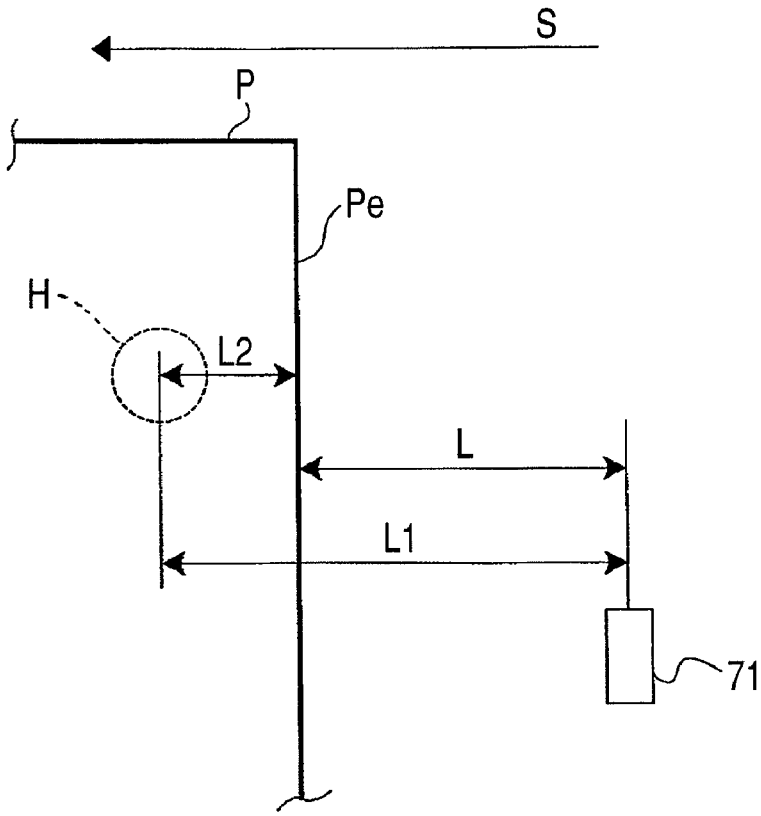
FIG. 5 is a diagram illustrating a positional relation between a punch trailing edge sensor and a stopped sheet.

Next, operations of the sheet processing apparatus 3 will be described with reference to FIG. 5.

The sheet processing apparatus 3 conveys the sheet P discharged by the discharge rollers 37 of the image forming apparatus main body 2 into the sheet processing apparatus 3 by the conveyance roller pair 61. In a case of conveying the conveyed sheet P to the discharged sheet stacking portion 5, in the sheet processing apparatus 3, the switching flapper 62 is switched and driven by a solenoid (not illustrated), whereby the sheet P is guided to the conveyance path "a". The sheet P guided to the conveyance path "a" is further conveyed by the conveyance roller pairs 63, 65, 66, and 67 and is discharged to the discharged sheet stacking portion 5.

On the other hand, in the sheet processing apparatus 3, in the case of subjecting the conveyed sheet P to the bookbinding processing, the switching flapper 62 is switched (in a state of switching flapper 62 illustrated in FIG. 3) so that the sheet P is guided to the conveyance path "b". When the sheet P is guided to the conveyance path "b", the following punching processing is executed by the sheet punch portion A.

The sheet P nipped by the conveyance roller pair 69 is conveyed to a downstream side in a sheet conveying direction, and is further conveyed to the downstream side by the conveyance roller pair 70. In this case, when the trailing edge of the sheet P is detected by the punch trailing edge sensor 71, the conveyance roller pair 70 conveys the sheet P by a predetermined distance L in the sheet conveying direction indicated by an arrow S of FIG. 5 from a position where the sheet P is detected, and then stops conveyance. In this case, a distance between a detection position of the punch trailing edge sensor 71 and a central position of the punch unit 72 (that is, a central position of punch hole H of sheet P) corresponds to a fixed distance L1. Further, a distance between a trailing edge Pe (edge on a side to be bound, or side edge on a side to be bound) of the sheet P and the central position of the punch hole H corresponds to a variable distance L2. The predetermined distance L corresponds to a difference between the fixed distance L and the variable distance L2. In other words, the sheet P is thus conveyed by the predetermined distance L to be stopped, whereby a desired punching position can be set so as to match the central position of the punch unit 72.

Then, the punch unit 72 faces the sheet P stopped at a position where the sheet P is conveyed by the predetermined distance L from the punch trailing edge sensor 71, and is driven to descend by a punch motor (not illustrated). As a result, the punch unit 72 nips the sheet P with the receiving portion 73 and subjects the sheet P to the punching processing. After the punching processing, chads generated in the punching processing are contained in the punch chad box 75, and the punch unit 72 is driven to ascend again from the receiving portion 73.

When the punching processing for the sheet P is finished and the punch unit 72 is driven to ascend, the sheet processing apparatus 3 resumes conveyance of the sheet P, which has been stopped, by the conveyance roller pair 70. After that, when the trailing edge Pe of the sheet P is detected by the sheet discharge sensor 77 disposed at an upstream side in the sheet conveying direction of the discharge rollers 76, a rotational speed of the discharge rollers 76 is switched to a predetermined speed V, whereby the discharge rollers 76 discharge the sheet P to the stacking portion 60. Note that, in the embodiment of the present invention, the speed V is set to, for example, 300 mm/s. Note that, in the case where the sheet P is discharged to the stacking portion 60, when the speed is considerably lower than the speed V, there may occur a state where the trailing edge Pe of the sheet P leans against the discharge rollers 76. On the contrary, when the speed of the discharge rollers 76 is considerably higher than the speed V, there may occur a state where the sheet P does not come to a standstill to be contained in the stacking portion 60. Accordingly, the speed for discharging the sheet P by the discharge rollers 76 is set to the predetermined speed V as described above.

Then, the sheet P conveyed from the sheet punch portion A is subjected to the following processing in the sheet stacking portion B.

The sheet P discharged from the discharge rollers 76 onto the support tray 60*a* is discharged at the predetermined speed V to be received on the support tray 60*a* without leaning against the discharge rollers 76. As illustrated in FIG. 3, the support tray 60*a*, as a whole, has a height which becomes lower toward the vicinity of the discharge rollers 76 (that is, upwardly inclined toward downstream side in sheet discharging direction of discharge rollers 76). As a result, the sheet P discharged from the discharge roller 76 to be received on the support tray 60*a* is moved toward the upstream side in the sheet discharging direction (lower-right direction in front view in FIG. 3) under its own weight to be brought into contact with the plate-like abutment member 60*b*. Accordingly, the edges of the sheet bundles 81 each including the plurality of sheets P stacked therein are aligned.

Further, in the stacking portion 60, the plate-like width aligning members 80 are vertically upwardly protruded from the support tray 60*a*. The plate-like width aligning members 80 are disposed so as to be movable in the width direction so that the sheet P discharged from the discharge rollers 76 is nipped from a horizontal width direction (in and out of the page of FIG. 3). At a time point when the leading edge of the sheet P being conveyed by the conveyance roller pair 70 reaches the discharge rollers 76, the width aligning member 80 moves to be positioned to have a width of 10 mm each on a left side and a right side in the horizontal width direction toward the outside of the position on the stacking portion 60 where the sheets P are stacked. Then, the width aligning member 80 is in a stand-by state.

When the sheet P discharged by the discharge rollers 76 is received on the stacking portion 60, the width aligning member 80 moves from a stand-by position to an inner side by 10 mm so as to nip the sheet P. In this manner, the above-mentioned alignment operation is repeated every time a sheet P is discharged onto the stacking portion 60, with the result that the positions of the left and right edges and the leading and trailing edges of the sheet bundle 81 are reliably aligned.

Note that an elapsed time from a time point when the trailing edge of the sheet P passes through the discharge rollers 76 is measured using a timer (not illustrated), to thereby determine whether the sheet P is received on the stacking portion 60. A timing when the trailing edge of the sheet P passes through the discharge rollers 76 can be easily determined based on a conveyance speed and a conveyance distance of the discharge rollers 76 measured after the trailing edge of the sheet P is detected by the sheet discharge sensor 77. In this case, when all the sheets to be book-bound are stacked on the stacking portion 60, prior to the processing by the bookbinding portion C, the position of each sheet of the sheet bundle is adjusted by the cylindrical abutment member 99 as described later.

The sheet P conveyed from the sheet stacking portion B is subjected to the following processing in the bookbinding portion C. Operations of the bookbinding portion C will be described with reference to FIGS. 6 to 13.

Figure 6:
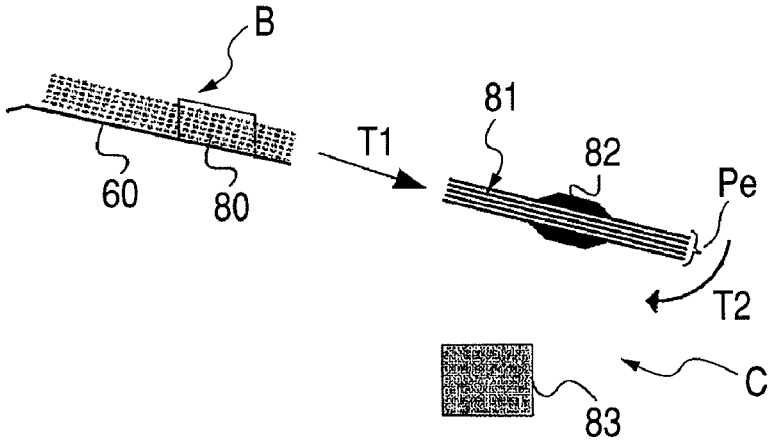
FIG. 6 is an explanatory diagram illustrating a first state of bookbinding processing in a bookbinding portion.
Figure 7:
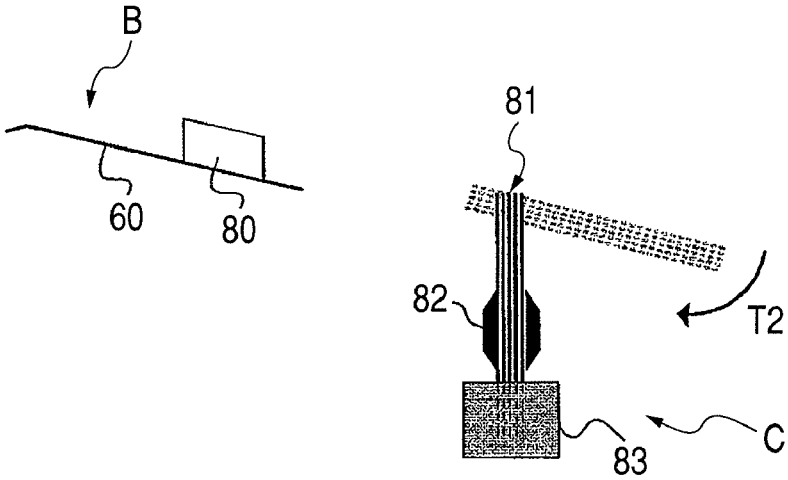
FIG. 7 is an explanatory diagram illustrating a second state of the bookbinding processing in the bookbinding portion.

As illustrated in FIG. 6, the sheet bundle 81 of the sheets P stacked on the stacking portion 60 and aligned is gripped by the gripper 82 on the stacking portion 60, and is moved upward of the bookbinding portion C from the sheet stacking portion B in a state of a bundle facing in a direction indicated by an arrow T1. As illustrated in FIG. 7, the sheet bundle 81 moved upward of the bookbinding portion C is rotated in a direction indicated by an arrow T2 so that a side to be bound with a binding member R (see FIG. 8), that is, a side on the trailing edge Pe of the sheet bundle 81 faces downward, while the sheet bundle 81 is gripped by the gripper 82.

When the sheet bundle 81 is moved in this manner, the trailing edge Pe of the sheet bundle 81 is in a state of facing the binding member carrying portion 83, that is, a state of being overlapped with the back side of the binding member carrying portion 83. The binding member R is attached in the state by the binding member carrying portion 83. A specific operation for attaching the binding member R will be described with reference to FIGS. 10 to 13 to be described later. Note that the binding member R is a spiral binder made of metal having a ring shape (curved shape) in cross section in a thickness direction of the sheet bundle to be bound. The spiral binder may be made of plastic other than metal, and a material thereof is not particularly limited as long as the spiral binder has hardness, flexibility, and the like required for the bookbinding processing.

When the sheet bundle 81 is moved to a position illustrated in FIG. 7 in the bookbinding portion C, attachment of the binding member R is then performed. The operation for attaching the binding member R in the bookbinding portion C will be described in detail below with reference to FIGS. 10 to 13.

Figure 10:
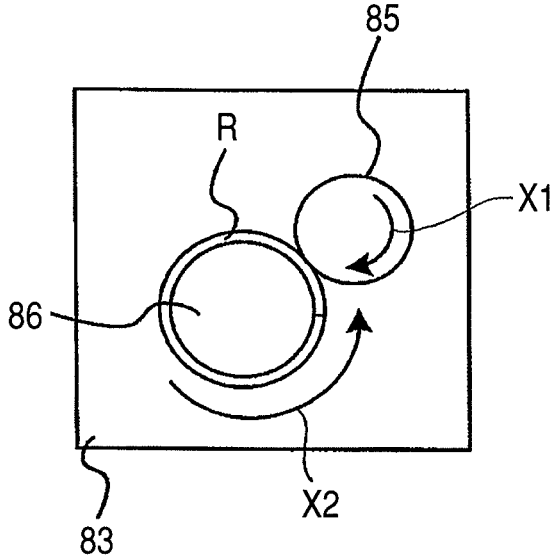
FIG. 10 is a schematic cross-sectional diagram illustrating a binding member carrying portion.

In this case, as illustrated in FIG. 10, the binding member carrying portion 83 in the bookbinding portion C includes a binding member conveying roller 85 for moving the binding member R, a motor (not illustrated) for driving the binding member conveying roller 85, and a binding member insertion shaft 86 for holding the binding member R. The binding member insertion shaft 86 has an outer diameter substantially equal to an inner diameter of the binding member R as viewed from the front, and has a spiral groove formed in the surface with the same pitch as that of the binding member R. The binding member insertion shaft 86 is fixed, and is not rotated nor moved even when the binding member conveying roller 85 is rotated to convey the binding member R.

Figure 11:
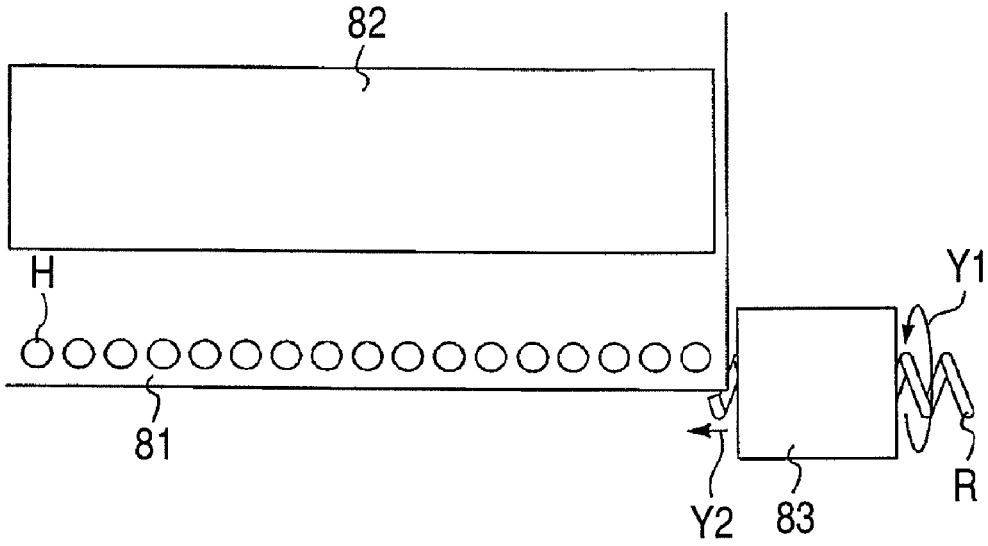
FIG. 11 is a schematic diagram illustrating an initial state of attachment of a binding member by the binding member carrying portion

In order to convey the binding member R, as illustrated in FIG. 10, a cylindrical outer surface of the binding member conveying roller 85 is brought into contact with the binding member R, which is set in the binding member insertion shaft 86, from an outside of the spiral shape. When the binding member conveying roller 85 is rotated by the motor (not illustrated) in the state in a direction indicated by an arrow X1, the binding member R set in the groove of the binding member insertion shaft 86 is rotated. As a result, as illustrated in FIG. 11, the binding member R starts to be carried in a direction indicated by an arrow Y2 along the groove of the binding member insertion shaft 86. Accordingly, the binding member carrying portion 83 sequentially delivers the binding member R toward the sheet bundle 81 from a leading end of the binding member R.

Figure 12:
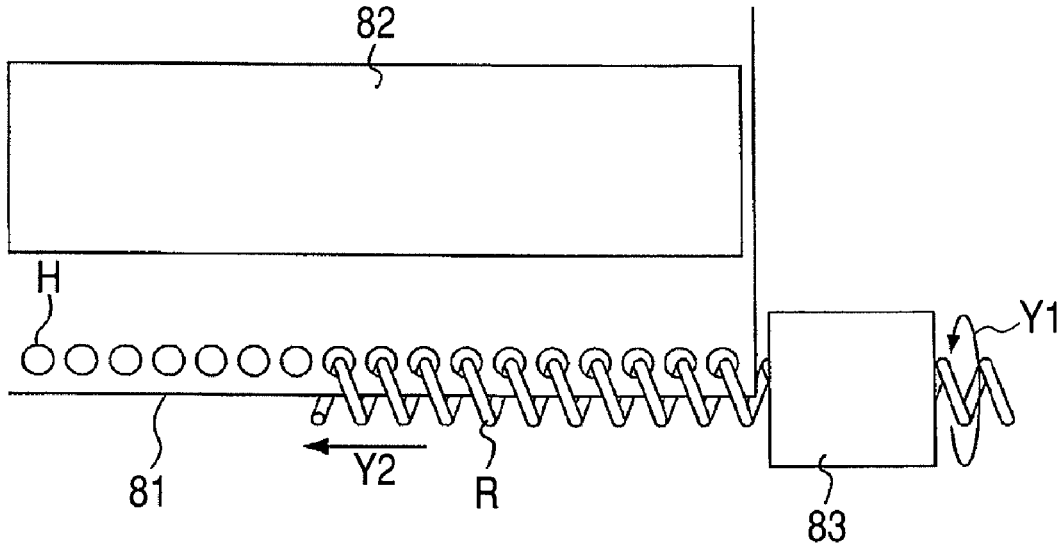
FIG. 12 is a schematic diagram illustrating a transient state of the attachment of the binding member by the binding member carrying portion.
Figure 13:
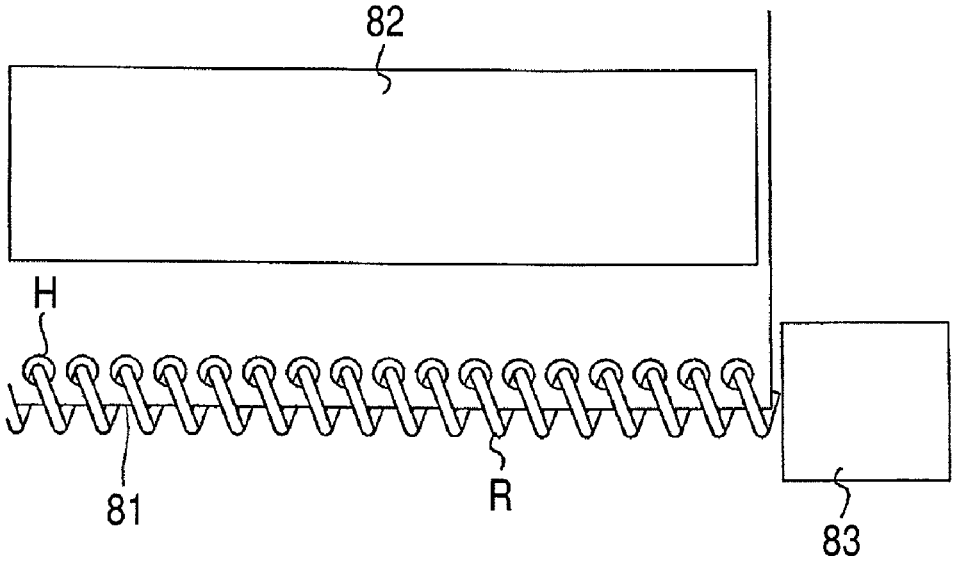
FIG. 13 is a schematic diagram illustrating a final state of the attachment of the binding member by the binding member carrying portion

When the sheet bundle 81 is moved to a bookbinding position upward of the book binding portion C by the gripper 82, as illustrated in FIG. 11, the binding member R starts to be carried by the binding member carrying portion 83. As illustrated in FIG. 12, the binding member carrying portion 83 causes the binding member R to be rotated so as to pass sequentially through the punch holes H of the sheet bundle 81 gripped by the gripper 82, from the leading edge of the binding member R. Then, as illustrated in FIG. 13, the binding member carrying portion 83 completes the conveyance (setting) of the binding member R at a time point when the binding member R is passed through all the punch holes H of the sheet bundle 81.

Figure 8:
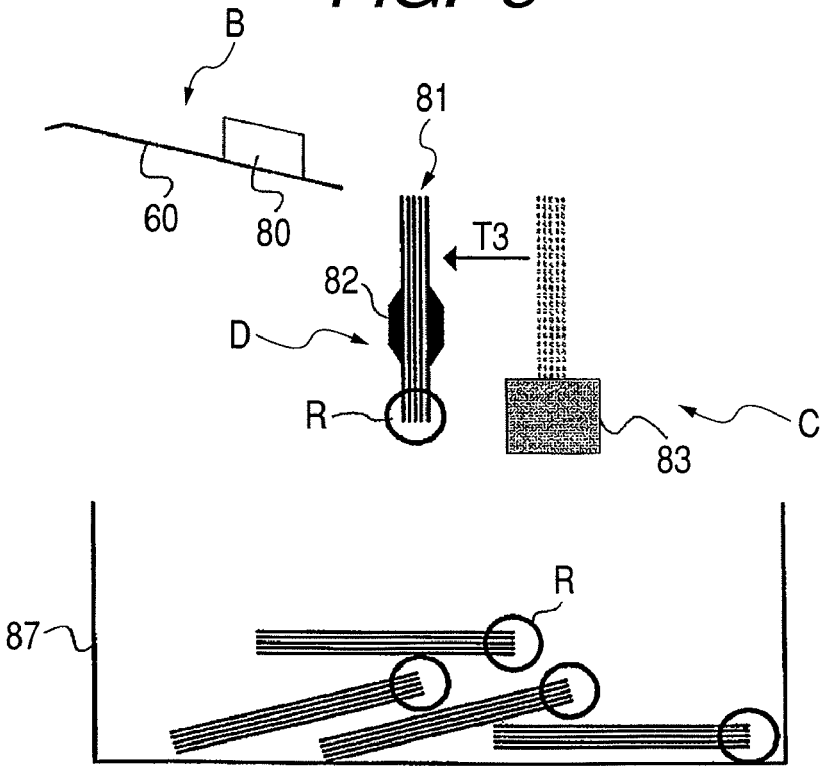
FIG. 8 is an explanatory diagram illustrating a third state of the bookbinding processing in the bookbinding portion.
Figure 9:
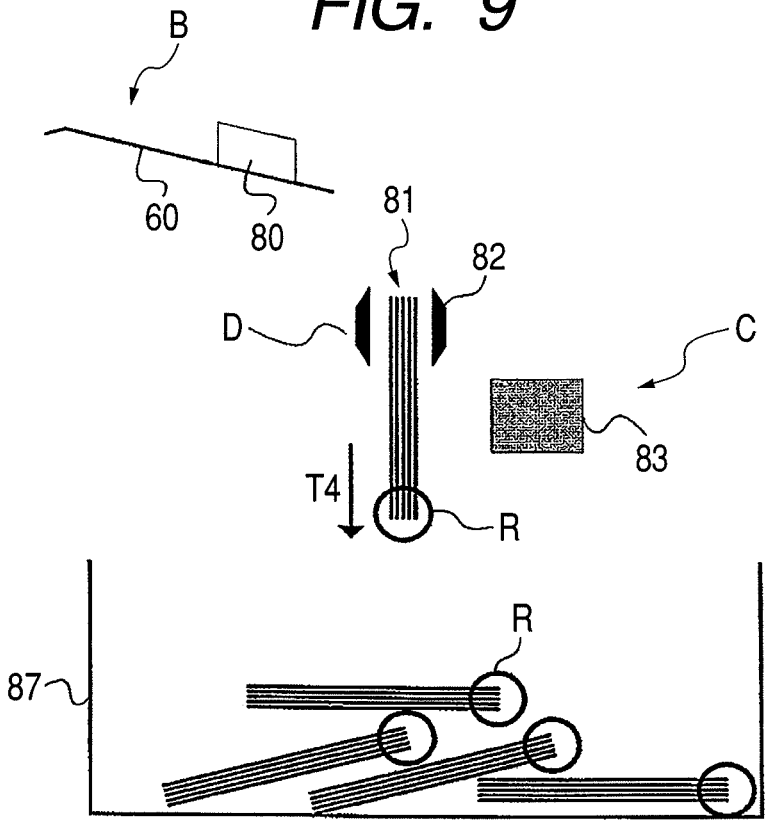
FIG. 9 is an explanatory diagram illustrating a fourth state of the bookbinding processing in the bookbinding portion.

As described above, when the binding member R is attached to the sheet bundle 81 by the binding member carrying portion 83, as illustrated in FIG. 8, the sheet bundle 81 is moved in a direction indicated by an arrow T3 while being gripped by the gripper 82, to be moved to the book-bound sheet bundle discharge portion D which is positioned upward of the sheet bundle stacking box 87. Then, when the sheet bundle 81 is moved to a predetermined position in the book-bound sheet bundle discharge portion D, as illustrated in FIG. 9, the state of the sheet bundle 81 gripped by the gripper 82 is released, and the sheet bundle 81 is dropped and contained in the sheet bundle stacking box 87.

Figure 16:
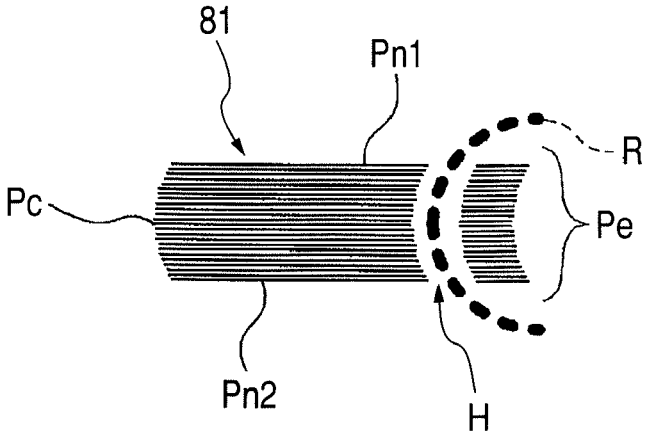
FIG. 16 is a schematic diagram illustrating an example of a cross section of a sheet bundle subjected to bookbinding processing in the bookbinding portion according to the embodiment of the present invention

Incidentally, the sheet processing apparatus 3 according to the embodiment of the present invention has a structure in which an attachment performance in the case of attaching the binding member R to the sheet bundle 81 in the bookbinding portion C is improved. Next, a description is given below of the structure and operations for improving the attachment performance of the binding member R, which are features of the present invention, with reference to FIGS. 16 and 19.

In the embodiment of the present invention, each distance from the trailing edge Pe of each sheet P of the sheet bundle 81 to the central position of each punch hole H is uniformly set. The position of the trailing edge Pe of each sheet P is adjusted so as to improve the attachment performance of the binding member R.

Figure 17:
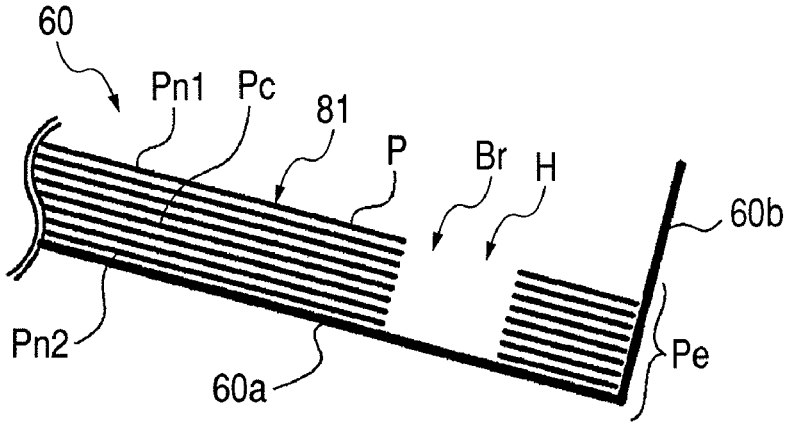
FIG. 17 is a schematic diagram illustrating an initial state of position adjustment of a sheet bundle by a cylindrical abutment member.

In other words, in the embodiment of the present invention, the punch unit 72 subjects all the sheets P to the punching processing at the same position. As a result, when the sheet bundle 81 is formed on the stacking portion 60, as illustrated in FIG. 17, punch holes Br, which are continuously formed in the thickness direction, are formed vertically with respect to a bottom surface 60*a* of the stacking portion 60 along the abutment member 60*b*. Note that a position where the sheets P, each of which has the punch hole formed in the sheet punch portion A, are sequentially stacked and the sheet bundle 81 is first formed on the stacking portion 60 is called a formation position.

Figure 18:
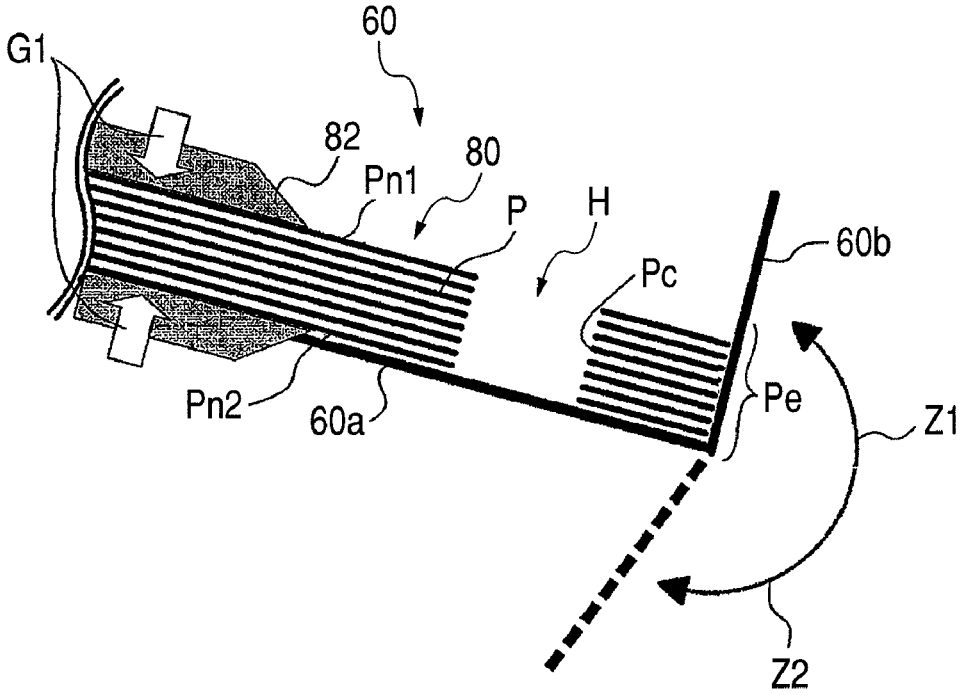
FIG. 18 is a schematic diagram illustrating a transient state of the position adjustment of the sheet bundle by the cylindrical abutment member.

When the sheet bundle 81 is formed on the stacking portion 60 as described above, the sheet bundle 81 is then gripped by the gripper 82 from a direction indicated by an arrow G1 of FIG. 18. When the sheet bundle 81 is gripped by the gripper 82, a thickness of the sheet bundle is measured using a sheet bundle thickness sensor 82*a* incorporated in the gripper 82. Results obtained through the measurement by the sheet bundle thickness sensor 82*a* are sent to the stack controlling portion 95. Then, upon completion of the measurement of the thickness of the sheet bundle 81 by the gripper 82, the stack controlling portion 95 controls the motor for driving the plate-like abutment member 60*b* so that the plate-like abutment member 60*b* provided so as to be rotatable in directions indicated by an arrow Z1 and an arrow Z2 performs an opening operation toward a position indicated by a broken line in the direction indicated by the arrow Z2.

Figure 19:
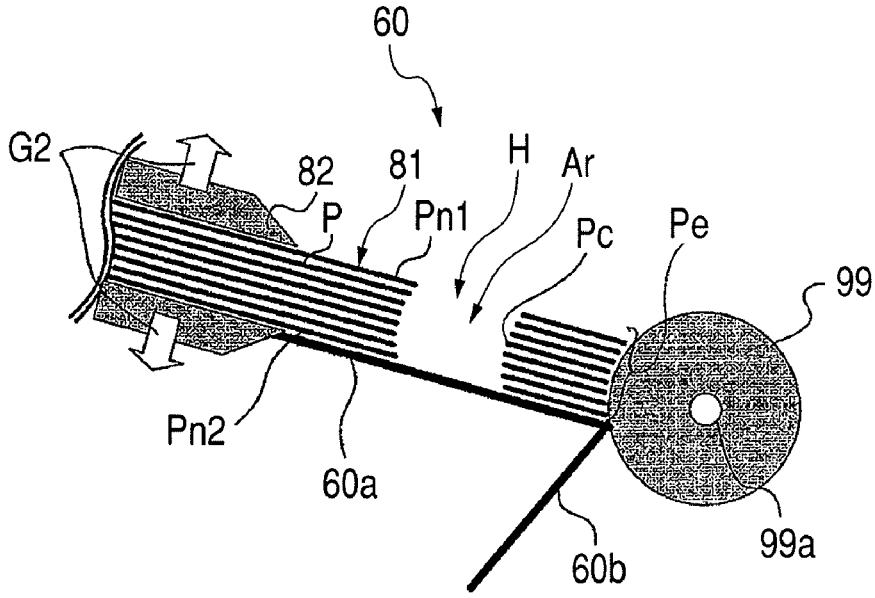
FIG. 19 is a schematic diagram illustrating a final state of the position adjustment of the sheet bundle by the cylindrical abutment member.
Figure 20:
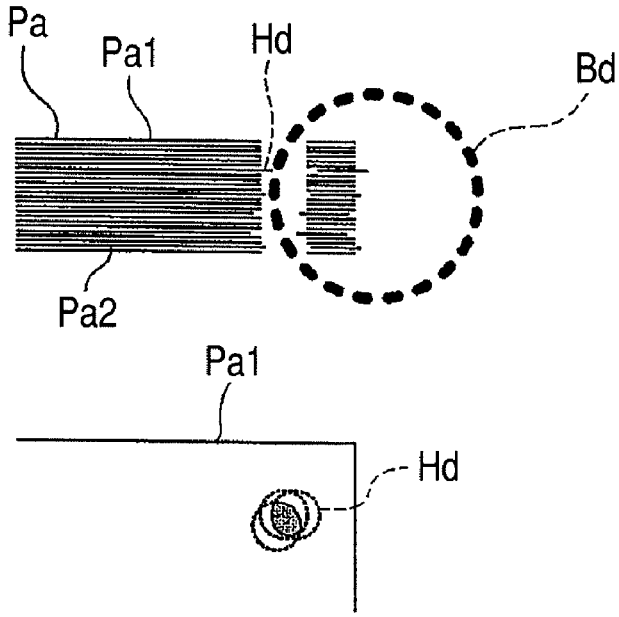
FIG. 20 is a schematic diagram illustrating an example of each of a sheet bundle and a punch hole according to a related art.
Figure 21:
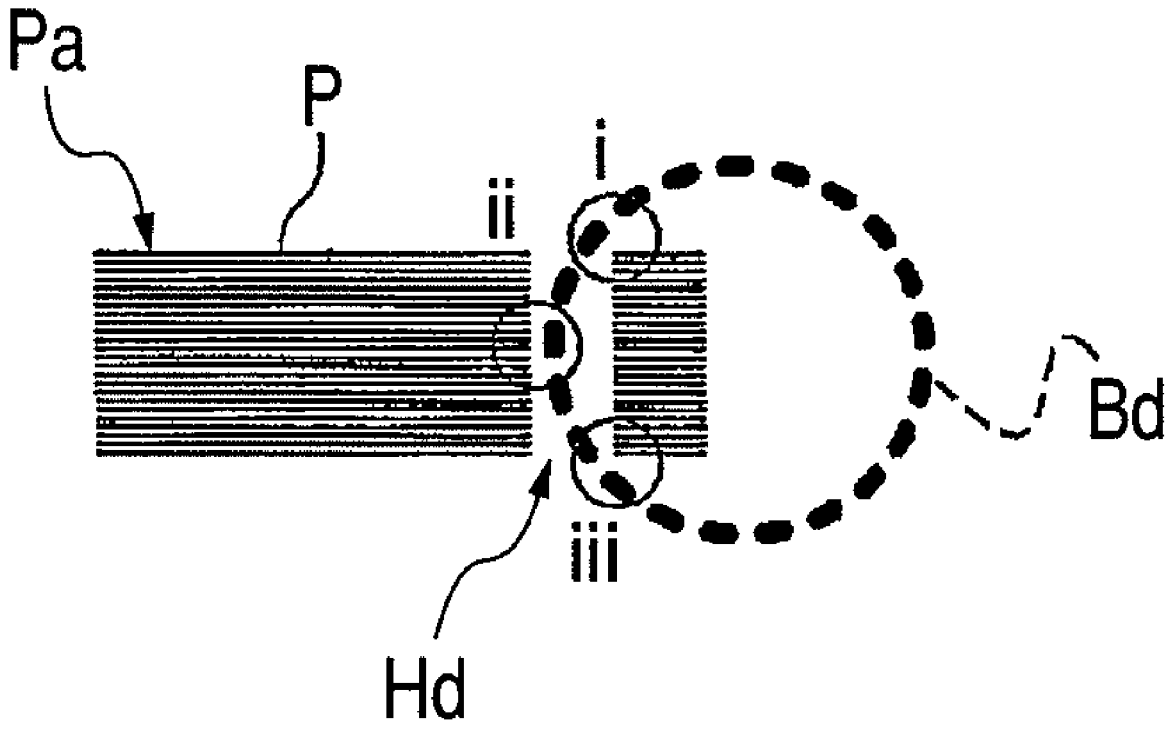
FIG. 21 is a schematic diagram illustrating another example of each of the sheet bundle and the punch hole according to the related art.

When the plate-like abutment member 60*b* performs the opening operation in the direction indicated by the arrow Z2, the plate-like abutment member 60*b* is separated from the trailing edge Pe of the sheet bundle 81. Then, as illustrated in FIG. 19, the cylindrical abutment member 99 formed with the same diameter as that of the binding member R to be attached is moved to a position where a cylindrical side surface (hereinafter, referred to as "pressing surface"), which curves toward the edge of the sheet bundle 81, is brought into contact with the edge of the sheet bundle 81. Specifically, the cylindrical abutment member 99 of this case is moved to a position where the center of the sheet bundle 81 in a height direction faces a shaft 99*a* of the cylindrical abutment member 99 according to the thickness of the sheet bundle 81 measured by the gripper 82. Operations of the cylindrical abutment member 99 are also controlled by the stack controlling portion 95.

When the cylindrical abutment member 99 is moved to the trailing edge Pe of the sheet bundle 81, the gripper 82 then loosens the grip of the sheet bundle 81, whereby the entire sheet bundle 81 is released from the gripper 82. In this case, the cylindrical abutment member 99 is moved substantially in contact with the trailing edge Pe of the sheet bundle 81, thereby preventing the sheet bundle 81 from slipping on the stacking portion 60 which is inclined.

Then, the cylindrical abutment member 99 operates so as to further press up the sheet bundle 81, which is in a received state, along the inclination of the stacking portion 60, that is, along the inclination of the support tray 60*a*, and moves to the position in contact with an end of the support tray 60*a*. As a result, the trailing edge Pe of the sheet bundle 81 is pressed back against the pressing surface of the cylindrical abutment member 99, and is rearranged to have a shape following the curved shape of the pressing surface. A circumferential surface of the cylindrical abutment member 99 has a shape following the shape of the binding member R. In other words, a curvature of the circumferential surface of the cylindrical abutment member 99 is equal to that of the binding member R. Accordingly, the punch holes H continuously formed in the sheet bundle 81 in the thickness direction thereof form a binding member attachment space Ar with a shape following the curved surface of the binding member R as illustrated in FIG. 19. The cylindrical abutment member 99 adjusts a position of each of the plurality of sheets forming the sheet bundle 81 so that a locus of centers of the punch holes continuing in a thickness direction of the sheet bundle 81 is aligned with the curved shape of the binding member R.

As a result, each sheet P of the sheet bundle 81 is moved from the formation position formed in the abutment member 60*b* of the stacking portion 60, in a state where the trailing edges Pe are held in parallel with each other, whereby each position of the sheets P is adjusted. In other words, the positions of the punch holes H of the sheets P of the sheet bundle 81 are adjusted such that the trailing edges Pe of the sheets P become sequentially apart from the formation position, from a sheet Pnl and a sheet Pn2 that are positioned at outer edges in the thickness direction of the sheet bundle 81 toward a sheet Pc positioned at the center in the thickness direction.

When the sheet bundle 81 is gripped by the gripper 82 again in the state where the positions of the sheets P are adjusted in the above-mentioned manner, the sheet bundle 81 is moved to the bookbinding portion C by the gripper 82 and is subjected to the bookbinding processing for attaching the binding member R as described above. In the bookbinding processing, the sheet bundle 81 is held in the adjusted state, the punch holes H penetrating through the sheet bundle 81 in the thickness direction have a shape following the shape of the binding member R and a shape surrounding a trajectory of the binding member R, whereby the attachment performance of the binding member R is improved.

Then, when the sheet bundle 81 is moved to the bookbinding portion C and left from the stacking portion 60, the cylindrical abutment member 99 is moved to an original stand-by position (not illustrated). Further, the plate-like abutment member 60*b* is rotationally operated in the direction indicated by the arrow Z1 by the motor (not illustrated), and is returned to the initial position where the sheet P positioned at the end of the stacking portion 60 is received, as illustrated in FIG. 17.

Note that the cylindrical abutment member 99 according to the embodiment of the present invention is detachable to the sheet processing apparatus 3, and can be replaced with one having a size matching the diameter of the binding member R. A position where the trailing edge Pe of the sheet bundle 81 is brought into contact with the cylindrical abutment member 99 is finely adjusted according to the thickness of the sheet bundle 81. Accordingly, even when the cylindrical abutment member 99 of any size is attached, the cylindrical abutment member 99 is moved to the position where the center of the sheet bundle 81 in the height direction faces the shaft 99*a* of the cylindrical abutment member 99.

Further, it has been described that the cylindrical abutment member 99 has a cylindrical shape, but the abutment member 99 may have a crescent shape with a surface which is in contact with the trailing edge Pe of the sheet bundle 81 being a curved surface. Further, instead of the shape uniform in a longitudinal direction such as the cylindrical shape, a shape having multiple circles penetrated therethrough on a skewer may be adopted. The shape of the cylindrical abutment member 99 is not particularly limited as long as the shape follows the curved shape of the trailing edge Pe of the sheet bundle 81.

As described above, according to the embodiment of the present invention, the position of the trailing edge Pe of each sheet P of the sheet bundle 81 is adjusted by the cylindrical abutment member 99 so that the binding member attachment space Br has the shape following the curved surface of the spiral binding member R. As a result, the binding member attachment space Ar formed in the sheet bundle 81 has the shape following the curved surface of the binding member R, whereby the binding member R can be smoothly attached without being brought into contact with the binding member attachment space Ar.

Accordingly, the binding member R is not brought into contact with an inner wall of the binding member attachment space Ar, thereby preventing the binding member R from being deformed, damaged, or the like, and preventing an accident such as a damage on the sheet bundle 81 from occurring. This leads to the improvement of the accuracy of the bookbinding processing for the sheet bundle 81, and also leads to the improvement of yields in the bookbinding processing.

Further, the cylindrical abutment member 99 adjusts the positions of the punch holes H such that the trailing edge Pe of the sheet Pc positioned at the center of the sheet bundle 81 in the thickness direction is more apart from the formation position, at which the sheet bundle 81 is formed, than each trailing edge of the sheet Pn1 and the sheet Pn2, which are positioned at the outer edges of the sheet bundle 81 in the thickness direction. As a result, in the case of attaching the spiral binding member R, the binding member R can be prevented from being brought into contact with the inner part of the binding member attachment space Ar formed in the sheet bundle 81, and the generation of deformation, breakage, or the like of the binding member R can be suppressed.

Further, the cylindrical abutment member 99 adjusts a stacking position of each sheet P of the sheet bundle 81 according to the diameter of the binding member R. As a result, the bookbinding processing can be performed depending on various binding members with various shapes and sizes.

Exemplary Embodiment

Hereinafter, an exemplary embodiment of the present invention will be described with reference to FIGS. 14 and 15. The basic structure of each of the image forming apparatus 1 and the sheet processing apparatus 3 is similar to that of the above embodiment, so a description thereof is omitted, and the identical or corresponding parts thereof are denoted by the same reference symbols.

Figure 14:
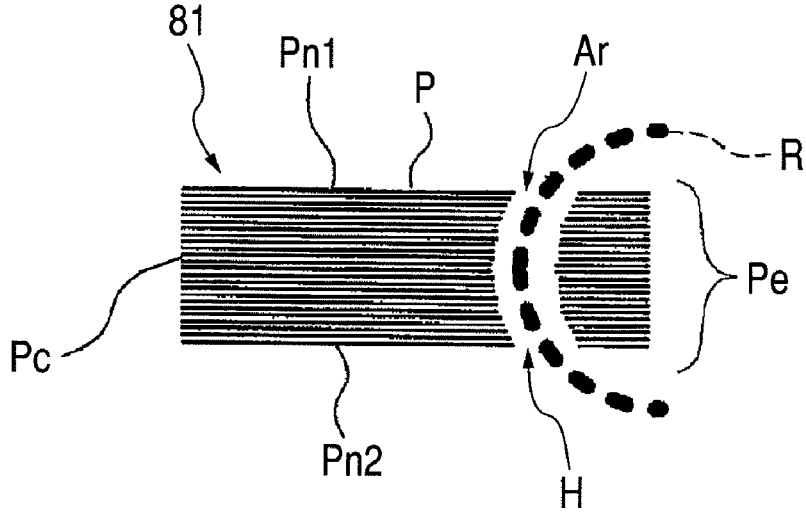
FIG. 14 is a schematic diagram illustrating an example of a cross section of a sheet bundle subjected to bookbinding processing in a bookbinding portion according to an exemplary embodiment of the present invention.
Figure 15:
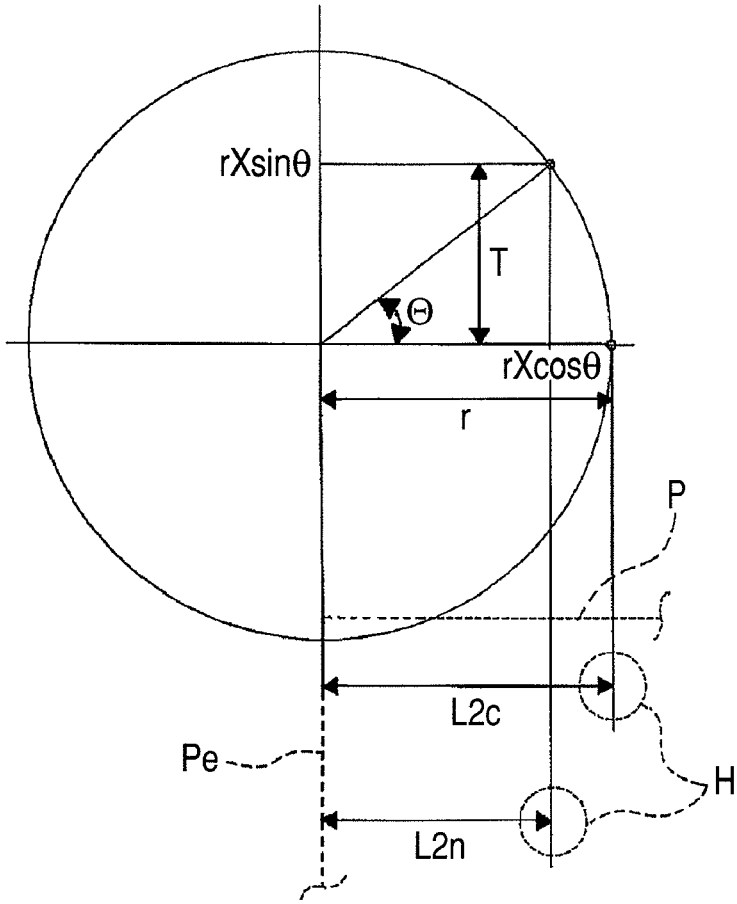
FIG. 15 is an explanatory diagram illustrating an example of processing for punching sheets according to the exemplary embodiment of the present invention

In other words, FIGS. 14 and 15 each illustrate an example where, instead of using the cylindrical abutment member 99 as described above, the punch hole position for each sheet of the sheet bundle 81 is changed so as to improve the attachment performance of the binding member R with respect to the sheet bundle 81. The punch hole position is changed such that the punch controlling portion 93 switches a stop position (distance L of FIG. 5) of each sheet P from the punch trailing edge sensor 71, thereby adjusting the variable distance L2 (see FIG. 5) from the trailing edge Pe of the sheet P to the central position of the punch hole H.

For example, the sheet (sheet positioned at center in thickness direction of sheet bundle) Pc stacked at the center in the thickness direction of the sheet bundle 81 is adjusted so that the distance between the trailing edge Pe and the center of the punch hole is set to be relatively longer as represented by a distance L2*c*. Meanwhile, the sheets positioned at the outer edges of the sheet bundle 81 in the thickness direction, that is, the sheet Pn1 and the sheet Pn2 are adjusted so that the distance between the trailing edge Pe and the center of the punch hole is set to be relatively shorter as represented by a distance L2*n*. Further, other sheets positioned between the sheet Pn1 and the sheet Pn2 are adjusted so that the distance between the trailing edge Pe and the center of the punch hole becomes shorter from the sheet Pc toward each of the sheet Pn1 and the sheet Pn2.

Specifically, a description is given of a process for determining the punch hole position of an n-th sheet when it is assumed that the number of sheets of the sheet bundle 81 is represented as N, a thickness of the sheet P is represented as β, and a radius of the binding member R to be attached to the sheet bundle 81 is represented as a distance (radius) r.

In a case of $n<N/2$, the n-th sheet is positioned at a distance (thickness of sheets) T represented by $(N/2-n+1)\times\beta$ in the thickness direction from the center (that is, center in height direction of sheet bundle) of the sheet bundle 81. Further, in a case of $n>N/2$, the n-th sheet is positioned at a distance T represented by $(n-N/2+1)\times\beta$ in the thickness direction from the center of the sheet bundle 81.

In this case, at the distance T, that is, the height in the thickness direction from the center of the sheet bundle 81 at the n-th sheet, an angle θ can be determined according to a formula $T=r\times\sin\theta$ based on the radius of the binding member R as illustrated in FIG. 15. As a result, as illustrated in FIG. 15, the distance L2*c* is represented by L2*c*=r, and the distance L2*n* is represented by L2*n*=r×cos θ. Accordingly, in a case of subjecting the n-th sheet to the punching processing, the n-th sheet is stopped on the more downstream side in the sheet conveying direction by a distance (r−L2*n*) than the distance (that is, distance r) of the stop position for the sheet Pc as a reference.

Note that, as the thickness β and the radius r of the binding member R described above, there are used values which are appropriately selected and set by a user from the operation indicating device 59 according to a sheet or a binding member to be used. The values appropriately selected and set are stored in advance in the ROM 90 of the sheet processing apparatus controlling portion 52 as table data, and the values are displayed on the operation indicating device 59 and can be selected by the user. In addition, the values may be detected to be used when a device capable of measuring each of the thickness β and the radius r of the binding member R is disposed and the bookbinding processing is performed in the bookbinding portion C. A method of obtaining the values is not particularly limited.

Further, the number of the sheets N of the sheet bundle 81 is counted when the originals are read by the image reader 6, and is stored in the RAM 91 of the sheet processing apparatus controlling portion 52 and is used.

Accordingly, based on the above-mentioned arithmetic processing, through adjustment of the stop position for each sheet P of the sheet bundle 81 formed on the stacking portion 60, the positions of the punch holes H of the sheets P of the sheet bundle 81 can be changed. Thus, when the sheets P are sequentially stacked on the staking portion 60 to be formed into the sheet bundle 81, the binding member attachment space Ar (see FIG. 14) formed of the punch holes communicating with each other in the thickness direction of the sheet bundle 81 is formed with a shape following the shape of the binding member R to be attached in the binding member carrying portion 83. In this case, there is formed a binding member attachment space which has an arc shape in cross section and is formed of the punch holes communicating with each other in the thickness direction of the sheet bundle 81 so as to follow a ring shape of the spiral binder. The sheet bundle 81 having the binding member attachment space Ar formed therein is gripped by the gripper 82 to be moved to the bookbinding portion C, and is subjected to the attachment of the binding member R, which is the bookbinding processing.

As described above, according to the embodiment of the present invention, the punch controlling portion 93 performs the punching processing by controlling the formation position of each punch hole of the sheets P. After that, the sheets P are sequentially stacked and formed into the sheet bundle 81 on the stacking portion 60. In this case, the binding member attachment space Ar formed of the punch holes H, which are continuously formed in the thickness direction of the sheet bundle 81, has a shape following the curved surface of the spiral binding member R. As a result, the attachment performance of the binding member R can be improved, and the stability and improvement of the accuracy in the bookbinding processing can be achieved.

Accordingly, the binding member R is not brought into contact with the inner wall of the binding member attachment space Ar in the case of attaching the binding member R. As a result, the binding member R can be prevented from being deformed, damaged, or the like, and the generation of an accident such as a damage on the sheet bundle 81 can be prevented. This leads to the improvement of the accuracy of the bookbinding processing for the sheet bundle 81, and also leads to the improvement of yields in the bookbinding processing.

Further, the punch controlling portion 93 adjusts the positions of the punch holes H formed in the sheets P based on the distance (for example, distance L) from each trailing edge Pe of the sheets P. Accordingly, the shape of the binding member attachment space Ar formed in the sheet bundle 81 can be adjusted.

Further, the punch controlling portion 93 adjusts the positions of the punch holes H of the sheets P so that the positions becomes closer to the trailing edges Pe of the sheet bundle 81, from the sheet Pc positioned at the center in the thickness direction of the sheet bundle 81 toward the sheet Pn1 and the sheet Pn2 that are positioned at outer edges in the thickness direction. As a result, the binding member attachment space Ar formed in the sheet bundle 81 follows the shape of the binding member R. Accordingly, in the case of attaching the binding member R, the binding member R can be prevented from being brought into contact with the inner part of the binding member attachment space Ar, and the generation of deformation, breakage, or the like of the binding member R can be suppressed.

Further, the punch controlling portion 93 adjusts the positions of the punch holes H of the sheets P according to at least one of the diameter of the binding member R and the number of sheets of the sheet bundle 81 (that is, thickness of sheet bundle 81) counted when the originals are read. Therefore, the bookbinding processing can be flexibly performed depending on various binding members and sheets with various shapes and sizes.

As described above, the sheet processing apparatus and the image forming apparatus according to the present invention are effectively used for the sheet processing apparatus for performing bookbinding processing using, for example, a spiral or circular binding member. In particular, the present invention is suitably used for the sheet processing apparatus and the image forming apparatus which require the stability and the improvement of the accuracy in the bookbinding processing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-098418, filed Apr. 4, 2007, which is hereby incorporated by reference herein in its entirety.

What is claimed is:

1. A sheet processing apparatus for binding a sheet bundle by a binding member having a curved shape, the sheet processing apparatus comprising:

a support portion configured to support, as a sheet bundle, a plurality of sheets having punch holes formed therein, each distance from a side edge of each sheet of the sheet bundle to a central position of each punch hole being uniform;

a sheet abutment member, which does not serve as the binding member, having a curved abutment surface that is curved to correspond to the curved shape of the binding member and that abuts against side edges of the plurality of sheets of the sheet bundle being supported by the support portion to adjust the position of each of the plurality of sheets of the sheet bundle so that the locus of centers of the punch holes continuing in the thickness direction of the sheet bundle is aligned with the curved shape of the binding member; and an attaching portion configured to attach the binding member to the punch holes of the sheet bundle in which the position of each of the plurality of sheets has been adjusted by the sheet abutment member.

2. A sheet processing apparatus according to claim 1, wherein the curved abutment surface abuts against the side edges of the plurality of sheets of the sheet bundle on a side of the sheet bundle to be bound by the binding member.

3. A sheet processing apparatus according to claim 1, wherein the curved abutment surface moves to press against the side edges of the plurality of sheets of the sheet bundle.

4. A sheet processing apparatus according to claim 1, further comprising a punch portion configured to form a punch hole in a sheet, wherein the support portion supports, as the sheet bundle, a plurality of sheets having punch holes formed therein by the punch portion.

5. An image forming apparatus, comprising:

an image forming portion for forming an image on a sheet;

a punch portion configured to form a punch hole in a sheet on which the image forming portion forms an image;

a support portion configured to support, as a sheet bundle, a plurality of sheets having punch holes formed therein by the punch portion, wherein the punch portion forms the punch hole in the sheet so that each distance of a side edge of each sheet of the sheet bundle to be supported by the support portion to a central position of each punch hole is uniform;

a sheet abutment member, which does not serve as a binding member, having a curved abutment surface that is curved to correspond to a curved shape of the binding member and that abuts against side edges of the plurality of sheets of the sheet bundle being supported by the support portion to adjust the position of each of the plurality of sheets of the sheet bundle so that the locus of centers of the punch holes continuing in the thickness direction of the sheet bundle is aligned with the curved shape of the binding member; and an attaching portion configured to attach the binding member to the punch holes of the sheet bundle in which the position of each of the plurality of sheets has been adjusted by the sheet abutment member.

6. An image forming apparatus according to claim 5, wherein the curved abutment surface abuts against the side edges of the plurality of sheets of the sheet bundle on a side of the sheet bundle to be bound by the binding member.

7. An image forming apparatus according to claim 5, wherein the curved abutment surface moves to press against the side edges of the plurality of sheets of the sheet bundle.

* * * * *